US007874613B2

(12) United States Patent
Tokatlian

(10) Patent No.: US 7,874,613 B2
(45) Date of Patent: Jan. 25, 2011

(54) CHAIR STABILIZER AND METHOD OF USE

(76) Inventor: John A. Tokatlian, 16753 Otsego St., Encino, CA (US) 91436

( * ) Notice: Subject to any disclaimer, the term of this patent is extended or adjusted under 35 U.S.C. 154(b) by 349 days.

(21) Appl. No.: 12/218,423

(22) Filed: Jul. 15, 2008

(65) Prior Publication Data

US 2010/0013290 A1 Jan. 21, 2010

(51) Int. Cl.
*A47B 83/02* (2006.01)

(52) U.S. Cl. ..... 297/143; 297/174 R; 297/463.1; 297/463.2; 248/351

(58) Field of Classification Search ..... 297/463.1, 297/463.2, 140, 143, 173, 174 R, 174 CS; 248/351, 229.1, 229.14
See application file for complete search history.

(56) References Cited

U.S. PATENT DOCUMENTS

| | | | | | |
|---|---|---|---|---|---|
| 57,255 | A | | 8/1866 | Marx | 297/142 |
| 85,050 | A | | 12/1868 | Anel | 297/174 CS |
| 275,508 | A | | 4/1883 | Miles | 297/174 CS |
| 946,942 | A | | 1/1910 | Linger | 297/140 |
| 1,337,103 | A | | 4/1920 | Straith | 297/174 CS |
| 1,793,035 | A | * | 2/1931 | Whitney | 248/351 |
| 2,504,897 | A | | 4/1950 | Stanton | 297/174 CS |
| 2,540,672 | A | | 2/1951 | Holmes | 297/174 CS |
| 2,820,507 | A | | 1/1958 | Provencher | 297/126 |
| 2,956,617 | A | | 10/1960 | Bruderer | 297/141 |
| 3,082,035 | A | | 3/1963 | Goolsby | 297/174 CS |
| 3,160,437 | A | | 12/1964 | Hill | 297/174 CS |
| 3,169,731 | A | * | 2/1965 | Phillips et al. | 248/351 |
| 4,009,904 | A | | 3/1977 | Sheldon | 297/217.1 |
| 4,014,592 | A | * | 3/1977 | Gist | 297/143 |
| 4,506,928 | A | | 3/1985 | Marion | 297/174 CS |

OTHER PUBLICATIONS

Button Clips web page, http://www.springandpressdevelopments.co.uk/services.htm (1 page).

* cited by examiner

*Primary Examiner*—Anthony D Barfield
(74) *Attorney, Agent, or Firm*—Cislo & Thomas, LLP

(57) ABSTRACT

A chair stabilizer for preventing injury to children or others who might tip over chairs. A removable chair-engaging section is removably and adjustably couplable to a table-engaging section. Generally, the entire apparatus is free standing but in conjunction with a flat or available undersurface, the table-engaging portion prevents rearward rotation of the chair as the table-engaging portion comes into contact with the underside of the flat surface, such as a table when the chair-engaging section is rotated. As a result, vulnerable individuals including children and the infirm are protected from impact with the ground should the chair begin tipping as the table restrains the rotational motion of the chair.

48 Claims, 6 Drawing Sheets

CHAIR STABILIZER AND METHOD OF USE

COPYRIGHT AUTHORIZATION

Portions of the disclosure of this patent document may contain material which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever. 37 C.F.R. §1.71(d).

BACKGROUND OF THE INVENTION

1. Field of the Invention

This invention relates to chair-stabilization devices and more particularly to devices (especially removable and portable devices) that stabilize adult-sized and other chairs for children to prevent the chair and the child from falling when leaning backwards.

2. Description of the Related Art

Small children unaccustomed to the world have a tendency to take risks that reflect their ignorance of the risks involved. Especially after mastering certain basic motor tasks, some children may be very adventurous in exploring the world and subject themselves to risk and possible injury. One such risk is the risk of injury that occurs from a toppling chair. A child may be unaware that the chair is unstable when the center of mass goes outside its usually stable position. Unaware that his or her weight (the masculine pronoun is used herein for convenience only), the child may stand on the chair and lean over its back or otherwise redistribute the weight of the child-chair system such that the chair becomes subject to possible toppling and/or tip over.

For example, a child transitioning between a booster seat and a regular adult chair may accidentally fall backwards. The chair may slam to the floor and the back or other part of the child's head may also hit the floor. There is a risk of serious injury and parents may feel desperately helpless. Children may also fall back while trying to situate themselves on adult-sized chairs.

Due to the inherently precious nature of children to their parents, as well as the concern individuals have of the safety of one another, there is a strong motivation to provide a safe environment for children as from the risks from wall sockets, table corners, and the like. This also includes the risks arising from chairs that could possibly topple when the child uses them or clambers upon them in a foreseeable and/or an unforeseeable, unanticipated, unintended, or unusual way.

Prior attempts have been made in the art with respect to stabilizing chairs, protecting individuals (especially children) from toppling their chairs, and otherwise. Brief descriptions of some of such prior attempts are set forth below. While the descriptions are believed to be accurate, no admission is made by them regarding their subject matter which is solely defined by the patent or reference involved.

In U.S. Pat. No. 4,506,928 to Marion, a portable baby chair is suspended from the edge of an ordinary table. A spring-biased set of pivoted locking bars on the chair's undertable supports engage the underside of the tabletop and prevent the chair from slipping. The table is trapped between table tangent sections 44/46 and the abutting sections 24/26 to generally hold the chair in place on the side of the table. Locking bars 54/56 serve to further secure the chair in place. Once the chair is in place, pushing the chair away from the table causes the tops of the locking bars to dig into the undersurface of the table and to hold the chair stationary.

In U.S. Pat. No. 3,160,437 to Hill, the table 21 has a tabletop 14 and an undersurface 15. See C-shaped channel 16 mounted to the undersurface by means of screws generally perpendicular to an inward from the edge at about the place where the chairs 22 are to be positioned. This system generally requires permanent changes to the chairs and/or table in contrast to your system.

In U.S. Pat. No. 3,082,035 to Goolsby, the substantially rigid hook serves to hold a highchair in place. Once engaged with the underside of a table, the hook 12 is restrained by a spring 55 and limits the travel of the highchair 19. Bracket 33 engages the hook via the pin 27 and allows pivoting of the hook.

In U.S. Pat. No. 2,956,617 to Bruderer et al, a baby chair is mounted on a table that requires permanent attachment of certain items to the underside of the table to enable the chair to fold into a collapsed position and enable movement of the chair underneath the table. The chair is generally help in place by channel members 29 that slide into the channel tracks 25 by means of support rollers 27. The chair shown in the Bruderer et al. system is not freestanding as it derives support from the underside of the table and would generally be inconvenient to use.

SUMMARY OF THE INVENTION

In view of the foregoing disadvantages inherent in the known types of chair stabilizing systems now present in the prior art, the present invention provides a chair stabilization system and method wherein the same can be used to protect children by stabilizing adult-type and other child-oversized chairs to prevent them from toppling over or tipping.

The general purpose of the present invention, which is described below in greater detail, is to provide a new chair stabilization system which has many of the advantages of previous stabilization systems mentioned here to form many novel features that result in a new chair stabilizer and method of use therefore, which are not anticipated, rendered obvious, suggested, taught, or even implied by any of the prior art stabilization systems for chairs in a method that's of use, either alone or in any combination thereof.

The chair stabilization system of the present invention has two basic components with a chair-engaging section and a table-engaging section. The chair-engaging section is removably attachable to a chair, such as a high back chair, that may allow a child to stand up and lean against the back of the chair and create a risk for the toppling over of the chair. A central articulating section provides a central support hub for an upward engaging section that engages the front part of the chair and a rearward extension that engages the back of the chair. The upward and rearward extensions along with their engagement plates enable contact and restriction between four sides of the chair seat: the top, front, rear, and bottom thereof.

The central articulating section generally enjoys a slidable telescoping relationship with the rearward extension. The rearward extension also engages a lower articulating section that is the lower part of the table-engaging section.

The table-engaging section has the lower articulating section as indicated above, as well as an upper table-engaging extension having a table-engagement plate. The lower articulating section also articulates in a manner similar to that for the central articulating section. The upper engaging extension is adjustably disposed to come into contact with the underside of the table should the chair (to which the chair-engaging section is attached) tilts backwards. The table-engagement plate at the upper end at the upper table-engaging extension comes into contact with the underside of the table or other generally flat undersurface as the entire structure at the table end of the present invention rises up according to the tilting of the chair. Once that table-engagement plate comes into contact with the underside of the table, the chair can no longer rotate as it is restrained by the connection between the chair-engaging section portion and the table-engaging portion.

Beyond the functionality as indicated above, the chair stabilization systems collapsibly folds into a very compact form for easy shipping and transport either prior to or after sale. The telescoping portion of the rearward extension and upward extension in the chair-engaging portion as well as the upper table-engaging extension of the table-engaging portion all telescope inwardly to collapse and create generally minimal dispersion of the extendable elements. The extendable elements then fold into a generally linear and parallel form to enable easy transport and storage.

The elements are locked into place by spring pins or the like, including other temporary (or possibly even permanent) fasteners. The geometrical arrangement of the central and lower articulating sections is also generally set forth in a predetermined fashion using spring pins or other fasteners to lock the articulating sections into place for both deployment and storage.

In one embodiment of the present invention, a chair-stabilizing system is provided that prevents a chair from overturning when adjacent to a generally flat undersurface such as that under a table. The chair-stabilizing system has a chair-engaging portion that detachably attaches to the chair. The chair-engaging portion has a front section and a rear section. The chair-stabilizing system also has a table-engaging portion that engages an underside of the table when the chair-engaging portion is engaging the chair and the chair-engaging portion is tilted rearwardly. The table-engaging portion is coupled to the front section of the chair-engaging portion. The chair engaged by the chair-engaging portion cannot (or is much less likely to) topple over rearwardly when the chair-stabilization system is in place as rearward rotation of the chair and the chair-engaging portion is prevented by contact of the table-engaging portion with an underside of the table. The chair-engaging portion prevents rotation of the chair yet the chair remains able to slide and move with respect to the table as it is not attached to the table.

In another embodiment of the present invention, a method for stabilizing a chair is provided that prevents the overturning of the chair when adjacent to a generally flat surface such as a table. The steps for the method include the providing of a chair-stabilizing system that has a chair-engaging portion and a table-engaging portion. The chair-engaging portion detachably attaches to the chair and the chair-engaging portion has a front section and a rear section. The table-engaging portion engages an underside of the adjacent table when the chair-engaging portion is engaging the chair and the chair-engaging portion is tilted rearwardly. The table-engaging portion is coupled to the front section of the chair-engaging portion. Other steps include engaging the chair with the chair-engaging portion and placing the table-engaging portion beneath the generally flat surface. In this way, the chair is engaged by the chair-engaging portion and cannot topple over rearwardly as rearward rotation of the chair-engaging portion is prevented by contact of the table-engaging portion with an underside of the generally flat surface or table. The chair-engaging portion prevents rotation of the chair while the chair remains able to slide and move with respect to the table as it is not attached to the table.

Other embodiments of the present invention are set forth in more detail, below, and the embodiments set forth above are made for purposes of example only and not of limitation.

DESCRIPTION OF THE PREFERRED EMBODIMENT(S)

Figure 1:
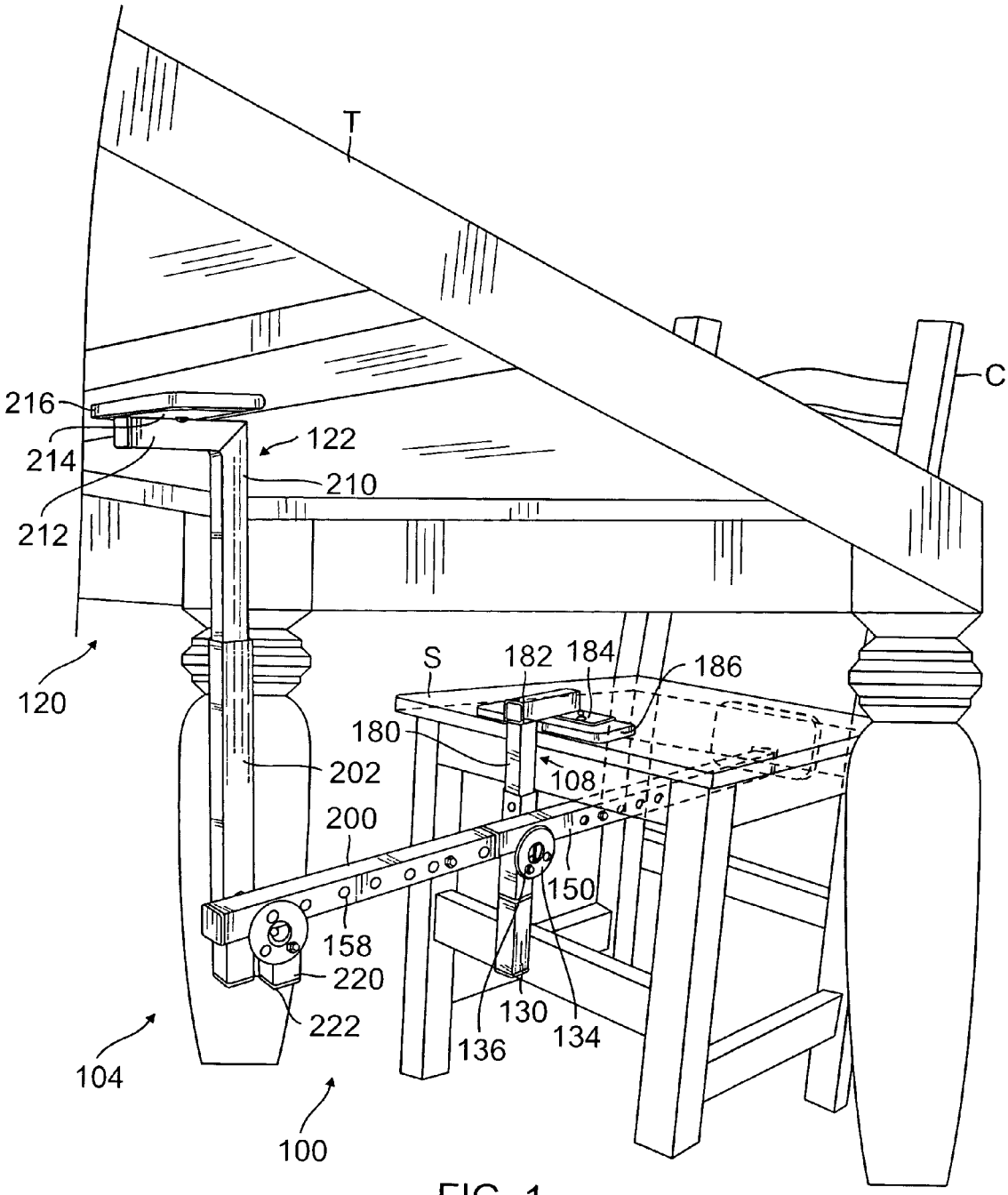
FIG. 1 is a left side perspective view of the present invention used in conjunction with a table and chair. Portions of the device in the chair are shown in phantom for greater clarity.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention. The masculine pronoun is generally used herein to indicate the generic individual and as a matter of convention and convenience.

The present invention resides in a chair stabilization system, device, and method to enable chairs to support curious and active children with a much-reduced risk of the chair toppling over due to imbalances created by the child's activities and/or torque about the chair's center of mass. As indicated above, chairs are subject to toppling over when a child climbs on the chair and perhaps leans over the back, taking the center of mass of the child-chair system outside of the four legs of the chair. The chair will initially tilt and may slowly or rapidly fall over, possibly with the legs of the chair sliding out from under the child. This can create the risk of injury as well as frightening the child and his parents. In a worst case scenario, the child's skull may be cracked or fractured and the risk of concussion could be great. As children are unaccustomed to the risks involved in falling and the like, the increased elevation created by the chair for the child's head also creates accompanying risks when that chair falls over with the child. The increase distance allows the child to suffer greater acceleration by gravity and consequently a greater speed at impact.

The present system stabilizes the chair by providing a removable table-engaging portion or flat surface engaging portion that is attached to a chair-engaging portion. The entire apparatus is foldable for easy transport and storage. The chair-engaging portion generally attaches to the seat of the chair while the table-engaging portion stands ready to come into contact with the underside of the chair should the chair tilt. The tilting of the chair causes accompanying and corresponding tilting of the chair-engaging portion which then lifts an upward end of the table-engaging portion. As the table-engaging portion has a top end generally close to, but preferably not touching, the underside of the table, the rearward tilting of the chair causes the top end of the table-engaging portion to contact the underside of the table (for example). The table then prevents the table-engaging portion from traveling further upward. This restriction in travel is then transmitted back to the chair-engaging portion and back to the chair.

If the table is light, the table may move with the tilting of the chair. However, this may give a parent, nearby adult, or other individual the time to engage/rescue the child. If the table is heavy, the combined weight of the child and chair may be insufficient to overcome the weight of the table and the chair will be fully stabilized.

Figure 2:
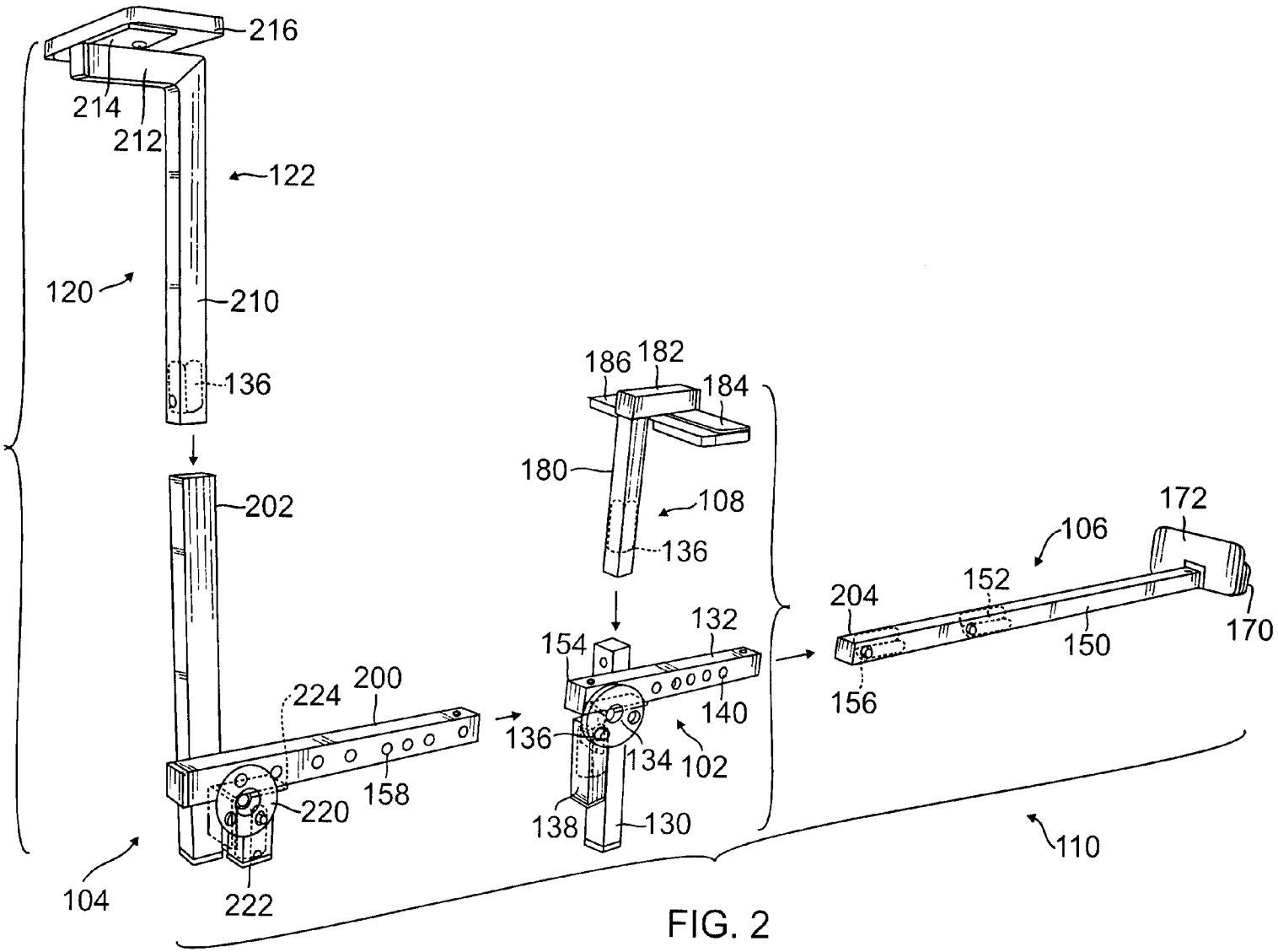
FIG. 2 is a left side perspective exploded view of the present invention showing its various components in a fashion similar to that as one deployed per FIG. 1.

Referring to the drawings, where like numerals of reference designate like elements throughout, it will be noted that FIG. 2 shows an exploded left side perspective view of the present invention with its various components. The chair stabilization system 100 has two articulating portions. A central articulating section 102 and a lower articulating section 104. Combined with the rearward extension 106 and the upward extension 108, the central articulating section 102 combines with these two extensions to form the chair-engaging portion 110.

Figure 3:
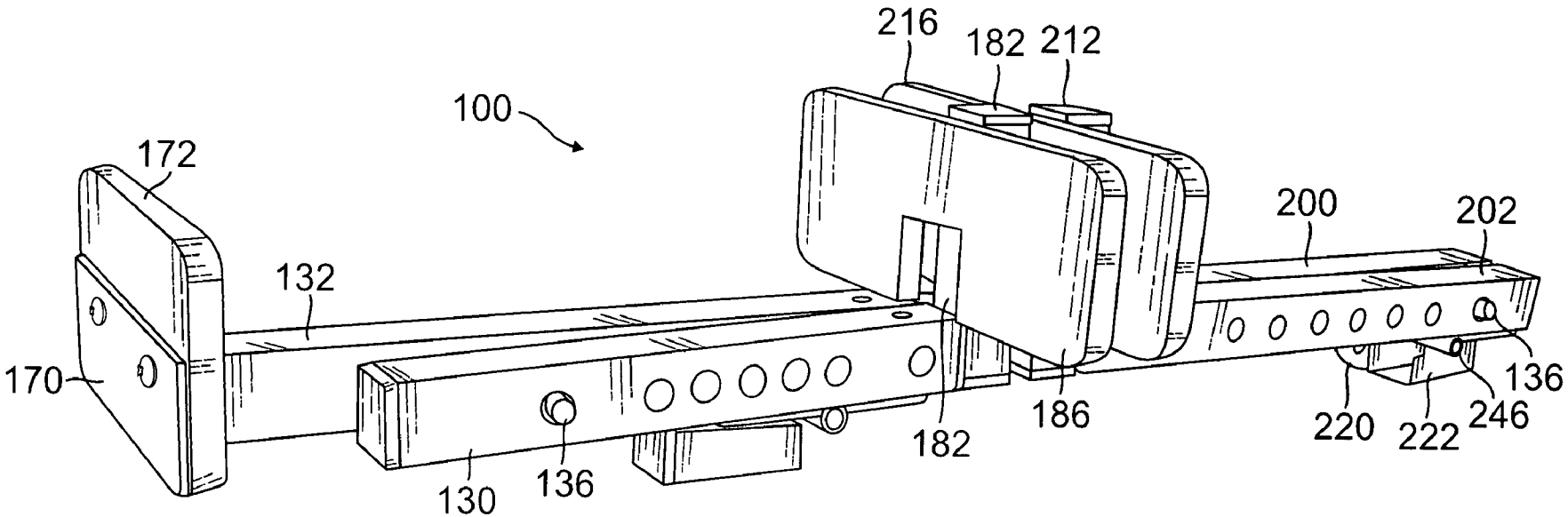
FIG. 3 is a top right side perspective view of the device shown in FIGS. 1 and 2 in a folded configuration.
Figure 4:
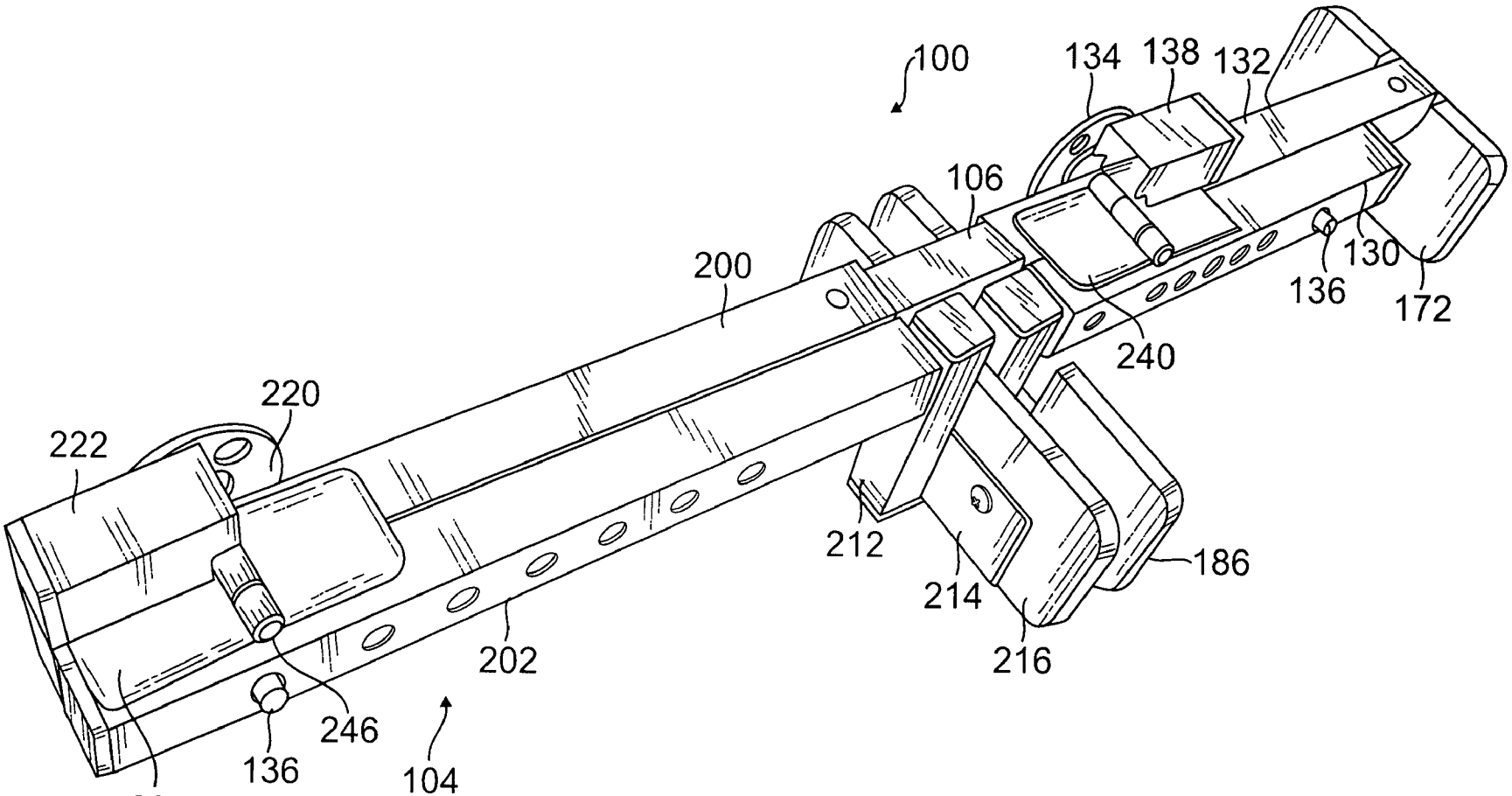
FIG. 4 is a right side perspective bottom view of the present device in the folded configuration of FIG. 3.

The table-engaging portion 120 includes the lower articulating section 104 as well as the upper flat surface-engaging extension or upper table-engaging extension 122. The chair-engaging portion 110 is coupled to the table-engaging portion 120 by the rearward extension 106 as indicated further below. Generally, the individual elements are stabilized and locked into place by spring pins, fasteners (temporary or permanent), or otherwise. As shown in FIGS. 3 and 4, the entire device is both foldable and collapsible to make for easy transport and storage. Conveniently, the generally modular nature of the individual components may lend the present invention to easier manufacturing. The central and lower articulating sections 102, 104 generally pivot between perpendicular and parallel configurations in order to achieve the ends of the present invention. The perpendicular configuration is shown in FIG. 2 while the parallel configurations are shown in FIGS. 3 and 4. Intermediate deployments or configurations are shown in the hinged portion of the lower articulating sections 104 in FIGS. 5 and 6.

Figure 5:
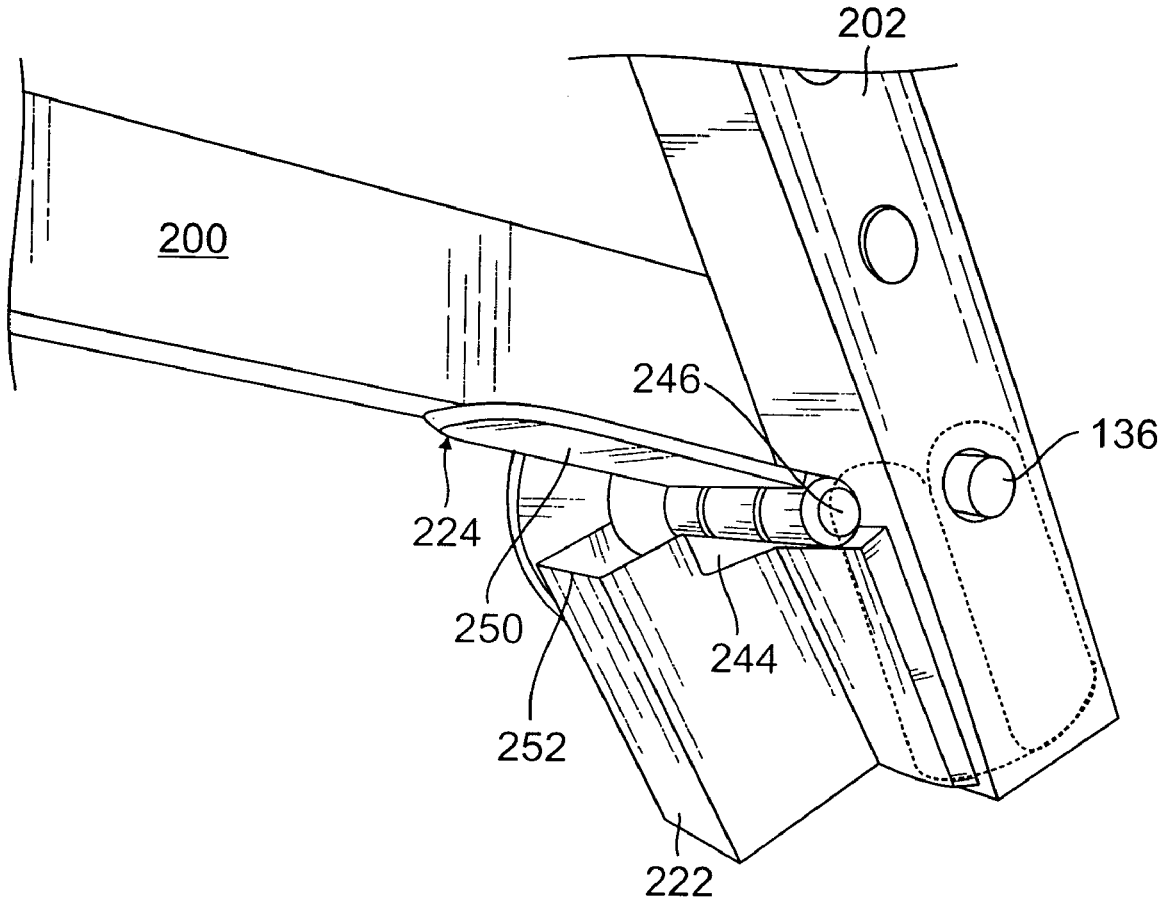
FIG. 5 is a close up of the articulated joint section on the right side of the lower articulating section of the table-engaging portion.
Figure 6:
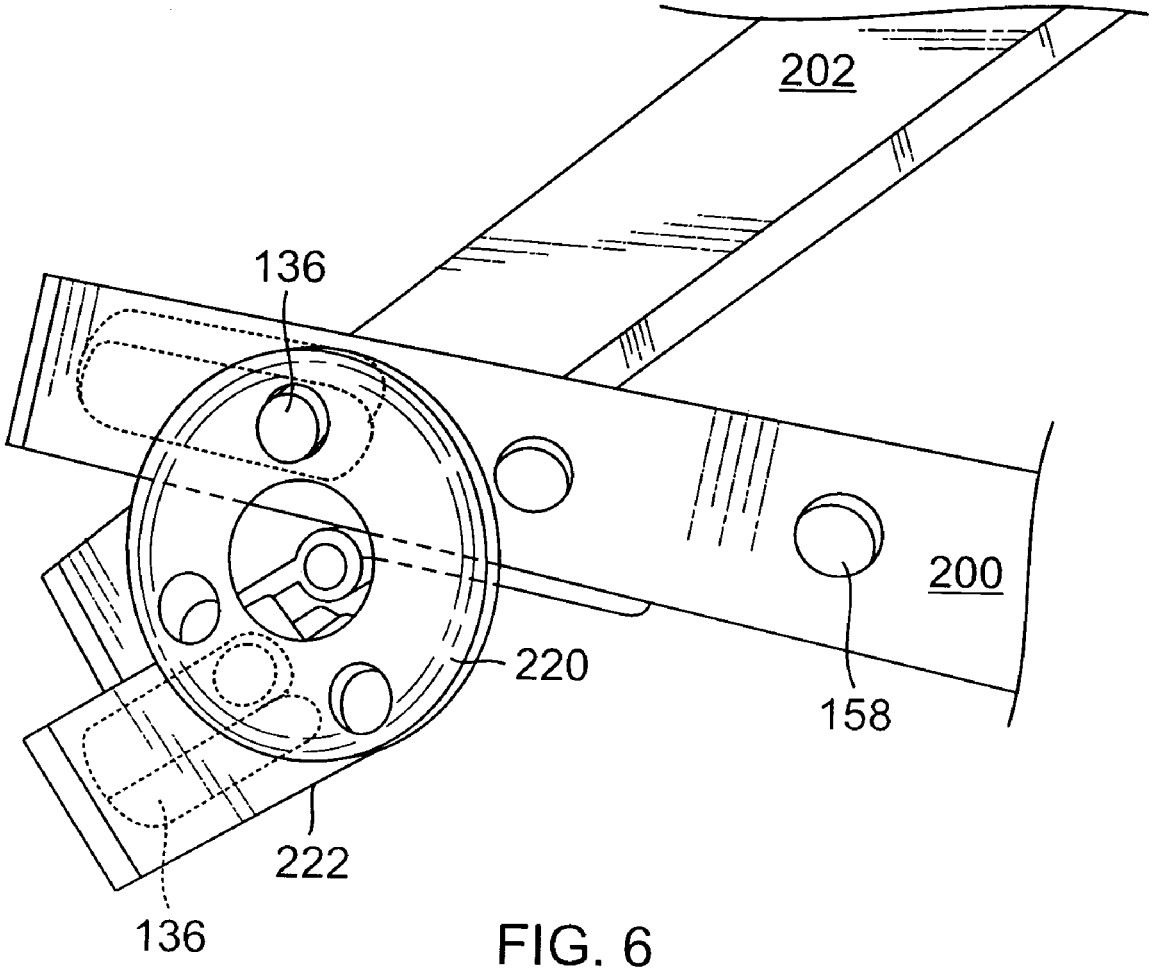
FIG. 6 is a left side view of the articulating hinged joint shown in FIG. 5.
Figure 7A:
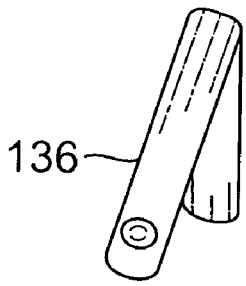
FIGS. 7A and 7B are front perspective and side views of a spring pin.
Figure 7B:
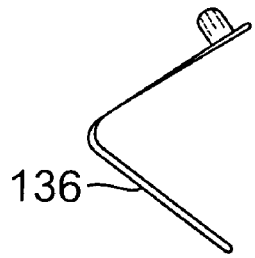

Beginning with the chair-engaging portion 110, the central articulating section 102 has a vertical sleeve 130 in hinged or other articulatable relationship with a horizontal sleeve 132 in the deployment shown in FIGS. 1 and 2. The vertical and horizontal sleeves 130, 132 are hinged together in a manner similar to that as shown in FIGS. 5 and 6 and about which more is described in greater detail below. As shown in phantom in FIG. 2, a hinge is present between the vertical and horizontal sleeves 130, 132.

In one embodiment, a washer 134 or other device may have holes 136 traveling therethrough in order to allow a spring pin 136 or other temporary fastener to travel through the hole and to lock the vertical and horizontal sleeves 130, 132 in relative place. A stop 138 is a generally directly attached to the vertical sleeve 130 to travel with it and to act as a stop for the horizontal sleeve 132. As with many of the components of the present invention 100, the stop 138 is generally made of tubular metal, such as steel, generally having a square cross section. The stop may be connected to the vertical sleeve 130 such that the long axes of these two elements are parallel. The top end of the stop 138 generally acts as an obstruction to the further angular travel of the horizontal sleeve 132 as it deploys from a configuration with the long axes of the vertical and horizontal sleeve 130, 132 being in parallel to that deployment shown in FIGS. 1 and 2 where those long axes are generally perpendicular.

As shown along the exposed side of the horizontal sleeve 132, holes 140 are present that allow travel and communication between the interior of the horizontal sleeve 132 and the exterior. As the rearward extension 106 at its long bar end 150 travels through the horizontal sleeve 132, the holes 140 in the horizontal sleeve 132 act as receptacles for the corresponding spring pin 152. When the spring pin 152 is set in place and travels through one of the horizontal sleeve holes 140, the rearward extension 106 is locked into place with respect to the central articulating section 102. Note should be taken that the near end 154 (as shown in FIG. 2) of the horizontal sleeve 132 is open so that the long bar end 150 of the rearward extension 106 may travel therethrough and on to the lower articulating section 104 of the table-engaging portion 120. In this way, both the central and lower articulating sections 102, 104 are adjustably coupled/attached to the long bar end 150 of the rearward extension 106. The lower articulating section 104 has corresponding holes for receiving a spring pin 156 for engaging the holes 158 to the lower articulating section 104.

As a result of the adjustable relationship between the rearward extension 106, the central articulating section 102 and the lower articulating section 104, the relative positioning of each of these elements can be individually controlled. In this way, the distance between the upward extension 108 and the rear engagement plate 170 can be adjusted according to the chair C involved.

The rear engagement plate 170 holds and supports a rear engagement pad 172 that is made of a generally compressible material that is non-abrasive and does not scratch, mar, or cosmetically injure the chair C. The rear engagement plate and rear engagement pad 170, 172 engage the rear of the chair C in order to hold it in place with respect to the central articulating section 102 and the upward extension 108.

In a manner similar to the rearward extension 106, the upward extension 108, as well as the upper table-engaging extension 122, enjoy similar sliding and telescoping relationships with their respective sleeves and similarly enjoy the same slidably adjustable relationship with their associated articulating sections 102, 104.

In FIG. 2, the upward extension 108 has a traveling bar portion 180 that ends in a sideways or lateral extension 182 that supports an upper engagement plate 184 which in turn provides support for an upward engagement pad 186. As the seats of chairs like the chair C are generally longer than they are tall, the long bar 150 of the rearward extension 106 is generally significantly longer than the traveling bar portion 180 of the upward extension 108. However, this may be adjustable according to cultural preferences for chairs and the like. Additionally, it allows different upward extensions to be used in conjunction with the same central articulating section 102 should the chair C for engagement by the chair-engaging portion 110 be taller might be normally expected.

The traveling bar portion 180 of the upward extension 108 has spring pin(s) 136 in a manner similar to that for the long bar end 150 of the rearward extension 106. Corresponding holes in the vertical sleeve 130 then receive the pins to enable lockably and lockable sliding and telescoping adjustment of the upward extension 108 with respect to the vertical sleeve 130.

Note should be taken that the non-abrasive pads 172, 186 generally face the chair in order to be the portion of the device 100 that comes into contact with the veneers or other surfaces of the chair seat.

As indicated above, the table-engaging portion 120 of the device 100 has a lower articulating section 104 into which the upper table-engaging extension 122 slidably fits. The lower articulating section 104 is constructed in a manner similar to that of the central articulating section 102 with a hinged relationship between the main sleeve 200 and the table sleeve 202. As indicated above, a proximal end 204 of the rearward extension 106 slides through the horizontal sleeve 132 of the central articulating section 102 and emerges out the open end 154 in order to telescope into the main sleeve 200 of the lower articulating section 104. Holes 158 in the main sleeve 200 engage the spring pin 156 in adjustable fashion so that the distances between the lower articulating section 104 and the central articulating section 102 as well as the distance between the lower articulating section 104 and the rear engagement place 170 can be adjusted.

The upper table-engaging extension 122 is constructed in a similar fashion to the upward extension 108. The upper table-engaging extension 122 has a descending bar 210 coupled to a forward extension 212 that is generally disposed at a right angle to the descending bar 210. The forward extension 212 carries on it a flat surface-engagement plate or flat table-engagement plate 214 that faces upward and supports a table pad 216.

Unlike the pads and plates for the rearward extension 106 and the upward extension 108, the table-engagement plate 214 and table pad 216 face outwardly in order to better engage the underside of a table T or other flat underside surface such as a countertop or the like. The table-engagement plate 214 is generally disposed perpendicularly to the forward extension 212 so as to better distribute any force applied to it as when the chair C tilts backwards and tilts the chair-engaging portion 110 rearward. The table pad 216 is of similar construction as the upper engagement pad 186 and the rear engagement pad 172. The main and table sleeves 200, 202 operate in a manner similar to that as the central articulating sections 102 with its vertical and horizontal sleeves 130, 132. A washer or other similar device 220 is generally directly attached to the table sleeve 202 and hingeably attached to the main sleeve 200. In conjunction with a stop 222, the washer 220 and hinge 224 (shown in phantom) operate to allow selectable articulation of the main and table sleeves 200, 202 of the lower articulating section 104. The stop 222 generally operates to prevent the main sleeve 200 from going past the perpendicular to the table sleeve 202. However, other embodiments may be realized for other angular configurations in this and the other sections of the present device.

Holes or similar may be present in the table sleeve 202 in order to allow a spring pin 136 in the descending bar 210 to selectably but securably engage and lock the upper table-engaging extension in place with respect to the table sleeve 202.

Note should be taken that the plates and pads for the upward extension 108 and the upper table-engaging extension 122 are offset away from the corresponding bar 180, 210 respectively so that the unit may fold in the compact manner shown in FIGS. 3 and 4. As the rearward extension generally keeps its plate 170 and pad 172 away from the main body of the folded configuration, such an offset is not generally necessary.

In summary, FIG. 2 shows the individual elements and their relationships with respect to the present invention. The different elements articulate into place to and from the folded configuration shown in FIG. 3 and 4 in order to engage a chair and table as shown in FIG. 1.

In FIG. 1, the rearward extension 106 traverses the bottom party of the seat S of the chair C so that the rear engagement plate and pad 170, 172 engage the rear of the seat S. Contemporaneously, the upward extension 108 is disposed to engage the top of the seat S with the upper plate and pad 184, 186. As the rearward and upward extensions 106, 108 are effectively locked into place by spring pins or the like with respect to the horizontal and vertical sleeves 130, 132, respectively, the seat S of the chair C is effectively locked into place and the chair-engaging portion 110 must now move with the chair C. The distal spring pin 156 of the rearward extension 106 is shown passing through one of the holes 158 of the lower articulating section 104, particularly the main sleeve 200. This locks the lower articulating section 104 in place with respect to the rearward extension 106. The upper table-engaging extension is likewise locked into place with respect to the lower articulating section 104 due to its being locked into position with respect to the table sleeve 202. As shown in FIG. 1, the table-engagement plate and pad 214, 216 are shown as generally adjacent or immediately below the underside of table T.

With the chair-engaging portion 110 securely in position on chair C and the table-engaging portion 120 securely engaged and associated with the chair-engaging portion 110 via the rearward extension 106, the chair stabilizer 100 is in place and properly deployed to protect a child who might shift his or her weight sufficiently on chair C to topple it over.

In FIG. 3, a right side folded view of the chair stabilizer is shown with the rearward extension 106 and generally fully telescoped within the horizontal sleeve 132. The vertical sleeve 130 has been rotated so that its long axis is parallel to the long axis of the horizontal sleeve 132. Additionally, the main sleeve 200 is generally almost fully engaged by the rearward extension 106 and the table sleeve 202 has been rotated so that its long axis is generally parallel to the long axis of the main sleeve 200. Spring pins or other temporary fastening/locking devices can be used to lock the chair stabilizer 100 into its folded and collapsed configurations as shown in FIGS. 3 and 4. As shown in FIG. 4, a right underside perspective view of the collapsed and folded chair stabilizer is shown, showing the hinge 224 for the lower articulating section 104 and the hinge 240 for the central articulating section 102.

When the chair stabilizer 100 is folded into its collapsed configuration, both the hinges 224, 240 are generally flat with the stops 222, 138 generally standing proud from the underside of the chair stabilizer 100. In conjunction with the washers 220, 134, spring pins (not shown in FIG. 4) protrude through associated holes in the washers 220, 134. This locks the articulating segments, namely the sleeves 130, 132, 200, 202, into place while the extending sections 106, 108 and 122 are generally locked into place by spring pins 136 associated with holes present in the respective sleeves.

As can be seen by inspection of the drawings, the collapsed, folded, or undeployed configuration of the chair stabilizer 100 requires significantly less space than that when it is deployed as shown in FIGS. 1 and 2. As indicated above, the extending portions 106, 108, 122 of the chair stabilizer 100 are made adjustable by the temporary fastening devices such as spring pins through the associated holes in the sleeves 130, 132, 200, 202.

FIGS. 5 and 6 show two sides of an articulating joint, namely the articulating portion of the lower articulating section 104. In conjunction with the small cutaway portion 244 that accommodates the pin portion 246 of the hinge 224, the stop 222 enables (in the case shown in FIG. 5 for the lower articulating section 104) the relative rotation between the main sleeve 200 and the table sleeve 202. The stop 222 is attached to the table sleeve 202 so that the stop 222 moves with the table sleeve 202. When the upper hinge plate 250 of the hinge 224 encounters the top part 252 of the hinge 222, the rotational motion of the main sleeve 200 is brought to a halt due to the obstruction of such motion by the stop 222.

Similarly, as the upper hinge plate 250 extends past the side of the main sleeve 200, when the table sleeve 202 and main sleeve 200 are brought together so that their long axes are parallel, the top side of the upper hinge plate 250 then stops the further rotational motion of the table sleeve 202 past parallel with respect to the main sleeve 200.

In a similar manner, the central articulating section 102 operates with its hinge 240 and stop 138.

As shown in FIG. 6, the table sleeve 202 and main sleeve 200 use a washer 220 to provide temporary locking between the stop 222 and the main sleeve 200. The holes present in the washer 220 are chosen so that the parallel and perpendicular configurations are easily available, but other embodiments for other geometrical configurations could be easily achieved.

A spring pin 136 shown in phantom within the stop 222 engages an associated hole in the washer 220 for each of the two positions (parallel and perpendicular) for the two sleeves 200, 202 as the stop 222 travels with the table sleeve 202. As can be determined by careful observation, the washer 220 must be attached to the main sleeve 200 much in the same way relatively that the stop 222 is attached to the table sleeve 202.

As indicated above, the same is similarly true for the washer or other stop mechanism 134 and stop 138 of the central articulating section 102.

The utility of the present invention lies in its reduction of risk of chairs toppling over and the accompanying diminishment of risk of injury to children by the same. The deployment of the chair is indicated above. Many materials may be used to construct the chair stabilizer of the present invention with cost possibly being a significant factor with regards to the materials involved. Expensive lightweight materials such as carbon fiber or titanium could be used, however economy may dictate that steel of sufficient thickness is adequate to protect children from chairs that might tip over, such chairs being the subject workpieces of the present invention.

These and other advantages, utilities, applications, and solutions provided by the present invention will be apparent from a review of the specification herein and accompanying drawings. The foregoing are some of but a few of the goals sought to be attained by the present invention and are set forth for the purposes of example only and not those of limitation.

While the present invention has been described with regards to particular embodiments, it is recognized that additional variations and embodiments of the present invention may be devised without departing from the inventive concept.

What is claimed is:

1. A collapsible and foldable chair-stabilizing system preventing the overturning of a chair when adjacent to a flat surface, the chair-stabilizing system comprising:

a chair-engaging portion, said chair-engaging portion having a front section and a rear section, said chair-engaging portion adapted to detachably attach to the chair;

a flat surface-engaging portion, said flat surface-engaging portion coupled to said front section of said chair-engaging portion, said flat surface-engaging portion adapted to engage an underside of the flat surface when said chair-engaging portion is engaging the chair and said chair-engaging portion is tilted rearwardly;

said rear section including a rearward extension adapted to engage a rear portion of the chair;

said front section including an upward extension adapted to engage a seat of the chair such that the chair is trapped between said rearward extension and said upward extension, said chair-engaging portion generally constrained to move with the chair;

said rearward extension passing under the seat of the chair to trap the seat between said upward extension and said rearward extension;

an upward engagement plate extending upwardly from a distal end of said rearward extension, said upward engagement plate adapted to engage a rear side of the seat of the chair;

a first pad coupled to said upward engagement plate and adapted to engage the rear side of the seat of the chair, said first pad providing a compressible and generally non-scratching surface;

said upward extension passing in front of a front portion of the chair to trap the seat between said rearward extension and said upward extension;

a rearward engagement plate extending rearwardly from a distal end of said upward extension, said rearward engagement plate adapted to engage a top side of the seat of the chair;

a second pad coupled to said rearward engagement plate and adapted to engage the top side of the seat of the chair, said second pad providing a compressible and generally non-scratching surface;

a central articulating section having first and second sleeves, said first sleeve hingedly coupled to said second sleeve;

said rearward extension telescopically engaging said first sleeve to provide an adjustable displacement for said rearward extension;

said upward extension telescopically engaging said second sleeve to provide an adjustable displacement for said upward extension;

said rearward and upward extensions being adjustably extendable with respect to said central articulating section;

a first stop coupled to said second sleeve and hingedly coupled to said first sleeve, said first stop permitting said first and second sleeves to fold parallel to one another and to unfold perpendicular to one another;

said first and second sleeves unlockably locking said rearward and upward extensions in place, respectively;

said first and second sleeves unlockably locking with respect to one another in said parallel and perpendicular positions;

said locking of said first and second sleeves with respect to said rearward and upward extensions and with respect to each other is achieved by means selected from the group consisting of: biased spring pins retractably extending through holes, removable fasteners of all sorts including bolts, screws, pins, detents, dowels, pegs, and posts, and combinations thereof;

a forward extension coupled to and generally linearly aligned with said rearward extension;

said flat surface-engaging portion having a lower articulating section telescopically and slidably coupled to said front section of said chair-engaging portion and having an upper flat surface-engaging extension slidably coupled to said lower articulating section;

said lower articulating section having third and fourth sleeves, said third sleeve hingedly coupled to said fourth sleeve;

said front section of said chair-engaging portion telescopically engaging said third sleeve to provide detachable attachment between said third sleeve and said front section;

said rear extension telescopically engaging said front section and said third sleeve to provide adjustable displacement for said rearward extension;

said upper flat surface-engaging extension telescopically engaging said fourth sleeve to provide an adjustable displacement for said upper flat surface-engaging extension such that said upper flat surface-engaging extension is adjustably extendable with respect to said lower articulating section;

a second stop coupled to said fourth sleeve and hingedly coupled to said third sleeve, said second stop permitting said third and fourth sleeves to fold parallel to one another and to unfold perpendicular to one another;

said third sleeve unlockably locking said front section and said rear extension in place;

said fourth sleeve unlockably locking said upper flat surface-engaging extension in place, respectively;

said third and fourth sleeves unlockably locking with respect to one another in said parallel and perpendicular positions;

said locking of said third and fourth sleeves with respect to said front section and said upper flat surface-engaging extension, respectively, and with respect to each other is achieved by means selected from the group consisting of: biased spring pins retractably extending through holes, removable fasteners of all sorts including bolts, screws, pins, detents, dowels, pegs, and posts, and combinations thereof;

said third sleeve telescopically engaging said forward extension of said front section of said chair-engaging portion and said rearward extension of said rear section of said chair-engaging section, said third sleeve telescopically receiving said forward extension that, in turn, telescopically receives said rearward extension;

said upper flat-surface-engaging extension further having a flat surface-engagement plate extending outwardly from a distal end of said upper flat surface-engaging extension, said flat surface-engagement plate adapted to engage an underside of the generally flat surface;

a third pad coupled to said flat surface-engagement plate and adapted to engage the underside of the generally flat surface, said third pad providing a compressible and generally non-scratching surface;

said rearward extension, said upward extension and said upper flat surface-engaging extensions all adapted to telescopically slide into said first, second, and fourth sleeves, respectively, to minimize displacements of said extensions; and said first, second, and fourth sleeves pivotably collapsing to align said first, second, and fourth sleeves with said third sleeve and said forward extension to minimize deployment of the chair-stabilizing system; whereby the chair engaged by said chair-engaging portion cannot topple over rearwardly when the chair-stabilizing system is deployed as rearward rotation of said chair-engaging portion is prevented by contact of said flat surface-engaging portion with an underside of the flat surface, said chair-engaging portion preventing rotation of the chair, the chair remaining able to slide and move with respect to the flat surface as it is not attached to the flat surface.

2. A method for stabilizing a chair to prevent the overturning of the chair when adjacent to a generally flat surface, the steps comprising:

providing a chair-stabilizing system having a chair-engaging portion and a flat surface-engaging portion;

said chair-engaging portion having a front section and a rear section, said chair-engaging portion adapted to detachably attach to the chair;

said flat surface-engaging portion coupled to said front section of said chair-engaging portion, said flat surface-engaging portion adapted to engage an underside of the flat surface when said chair-engaging portion is engaging the chair and said chair-engaging portion is tilted rearwardly;

said rear section including a rearward extension adapted to engage a rear portion of the chair;

said front section including an upward extension adapted to engage a seat of the chair such that the chair is trapped between said rearward extension and said upward extension, said chair-engaging portion generally constrained to move with the chair;

said rearward extension passing under the seat of the chair to trap the seat between said upward extension and said rearward extension;

an upward engagement plate extending upwardly from a distal end of said rearward extension, said upward engagement plate adapted to engage a rear side of the seat of the chair;

a first pad coupled to said upward engagement plate and adapted to engage the rear side of the seat of the chair, said first pad providing a compressible and generally non-scratching surface;

said upward extension passing in front of a front portion of the chair to trap the seat between said rearward extension and said upward extension;

a rearward engagement plate extending rearwardly from a distal end of said upward extension, said rearward engagement plate adapted to engage a top side of the seat of the chair;

a second pad coupled to said rearward engagement plate and adapted to engage the top side of the seat of the chair, said second pad providing a compressible and generally non-scratching surface;

a central articulating section having first and second sleeves, said first sleeve hingedly coupled to said second sleeve;

said rearward extension telescopically engaging said first sleeve to provide an adjustable displacement for said rearward extension;

said upward extension telescopically engaging said second sleeve to provide an adjustable displacement for said upward extension;

said rearward and upward extensions being adjustably extendable with respect to said central articulating section;

a first stop coupled to said second sleeve and hingedly coupled to said first sleeve, said first stop permitting said first and second sleeves to fold parallel to one another and to unfold perpendicular to one another;

said first and second sleeves unlockably locking said rearward and upward extensions in place, respectively;

said first and second sleeves unlockably locking with respect to one another in said parallel and perpendicular positions;

said locking of said first and second sleeves with respect to said rearward and upward extensions and with respect to each other is achieved by means selected from the group consisting of: biased spring pins retractably extending through holes, removable fasteners of all sorts including bolts, screws, pins, detents, dowels, pegs, and posts, and combinations thereof;

a forward extension coupled to and generally linearly aligned with said rearward extension;

said flat surface-engaging portion having a lower articulating section telescopically and slidably coupled to said front section of said chair-engaging portion and having an upper flat surface-engaging extension slidably coupled to said lower articulating section;

said lower articulating section having third and fourth sleeves, said third sleeve hingedly coupled to said fourth sleeve;

said front section of said chair-engaging portion telescopically engaging said third sleeve to provide detachable attachment between said third sleeve and said front section;

said rear extension telescopically engaging said front section and said third sleeve to provide adjustable displacement for said rearward extension;

said upper flat surface-engaging extension telescopically engaging said fourth sleeve to provide an adjustable displacement for said upper flat surface-engaging extension such that said upper flat surface-engaging extension is adjustably extendable with respect to said lower articulating section;

a second stop coupled to said fourth sleeve and hingedly coupled to said third sleeve, said second stop permitting said third and fourth sleeves to fold parallel to one another and to unfold perpendicular to one another;

said third sleeve unlockably locking said front section and said rear extension in place;

said fourth sleeve unlockably locking said upper flat surface-engaging extension in place, respectively;

said third and fourth sleeves unlockably locking with respect to one another in said parallel and perpendicular positions;

said locking of said third and fourth sleeves with respect to said front section and said upper flat surface-engaging extension, respectively, and with respect to each other is achieved by means selected from the group consisting of: biased spring pins retractably extending through holes, removable fasteners of all sorts including bolts, screws, pins, detents, dowels, pegs, and posts, and combinations thereof;

said third sleeve telescopically engaging said forward extension of said front section of said chair-engaging portion and said rearward extension of said rear section of said chair-engaging section, said third sleeve telescopically receiving said forward extension that, in turn, telescopically receives said rearward extension;

said upper flat surface-engaging extension further having a flat surface-engagement plate extending outwardly from a distal end of said upper flat surface-engaging extension, said flat surface-engagement plate adapted to engage an underside of the generally flat surface;

a third pad coupled to said flat surface-engagement plate and adapted to engage the underside of the generally flat surface, said third pad providing a compressible and generally non-scratching surface;

said rearward extension, said upward extension and said upper flat surface-engaging extensions all adapted to telescopically slide into said first, second, and fourth sleeves, respectively, to minimize displacements of said extensions;

said first, second, and fourth sleeves pivotably collapsing to align said first, second, and fourth sleeves with said third sleeve and said forward extension to minimize deployment of the chair-stabilizing system;

engaging the chair with said chair-engaging portion; and placing said flat surface-engaging portion beneath the generally flat surface; whereby the chair engaged by said chair-engaging portion cannot topple over rearwardly when the chair-stabilizing system is deployed as rearward rotation of said chair-engaging portion is prevented by contact of said flat surface-engaging portion with an underside of the flat surface, said chair-engaging portion preventing rotation of the chair, the chair remaining able to slide and move with respect to the flat surface as it is not attached to the flat surface.

3. A chair-stabilizing system preventing the overturning of a chair when adjacent to a generally flat surface, the chair-stabilizing system comprising:

a chair-engaging portion, said chair-engaging portion having a front section and a rear section, said chair-engaging portion adapted to detachably attach to the chair; and a flat surface-engaging portion, said flat surface-engaging portion coupled to said front section of said chair-engaging portion, said flat surface-engaging portion adapted to engage an underside of the flat surface when said chair-engaging portion is engaging the chair and said chair-engaging portion is tilted rearwardly; whereby the chair engaged by said chair-engaging portion cannot topple over rearwardly as rearward rotation of said chair-engaging portion is prevented by contact of said flat surface-engaging portion with an underside of the flat surface, said chair-engaging portion preventing rotation of the chair, the chair remaining able to slide and move with respect to the flat surface as it is not attached to the flat surface.

4. A chair-stabilizing system preventing the overturning of a chair when adjacent to a generally flat surface as set forth in claim 3, the chair-stabilizing system further comprising:

a chair-stabilizing system that is collapsible and foldable.

5. A chair-stabilizing system preventing the overturning of a claim when adjacent to a generally flat surface as set forth in claim 3, wherein said chair-engaging portion further comprises:

said rear section including a rearward extension adapted to engage a rear portion of the chair; and said front section including an upward extension adapted to engage a top portion of the chair; whereby the chair is trapped between said rearward extension and said upward extension, said chair-engaging portion generally constrained to move with the chair.

6. A chair-stabilizing system preventing the overturning of a claim when adjacent to a generally flat surface as set forth in claim 5, wherein said rearward extension further comprises:

said rearward extension passing under the top portion of the chair to trap the top portion between said upward extension and said rearward extension.

7. A chair-stabilizing system preventing the overturning of a claim when adjacent to a generally flat surface as set forth in claim 6, wherein said rearward extension further comprises:

an upward engagement plate extending upwardly from a distal end of said rearward extension, said upward engagement plate adapted to engage a rear side of the top portion of the chair.

8. A chair-stabilizing system preventing the overturning of a chair when adjacent to a generally flat surface as set forth in claim 7, wherein said upward engagement plate further comprises:

a first pad coupled to said upward engagement plate and adapted to engage the rear side of the top portion of the chair, said first pad providing a compressible and generally non-scratching surface.

9. A chair-stabilizing system preventing the overturning of a chair when adjacent to a generally flat surface as set forth in claim 5, wherein said upward extension further comprises:

said upward extension passing in front of a front portion of the chair to trap the top portion between said rearward extension and said upward extension.

10. A chair-stabilizing system preventing the overturning of a chair when adjacent to a generally flat surface as set forth in claim 9, wherein said upward extension further comprises:

a rearward engagement plate extending rearwardly from a distal end of said upward extension, said rearward engagement plate adapted to engage a top side of the top portion of the chair.

11. A chair-stabilizing system preventing the overturning of a chair when adjacent to a generally flat surface as set forth in claim 10, wherein said upward engagement plate further comprises:

a second pad coupled to said rearward engagement plate and adapted to engage the top side of the top portion of the chair, said second pad providing a compressible and generally non-scratching surface.

12. A chair-stabilizing system preventing the overturning of a chair when adjacent to a generally flat surface as set forth in claim 5, wherein said chair-engaging portion further comprises:

a central articulating section having first and second sleeves, said first sleeve hingedly coupled to said second sleeve;

said rearward extension slidably engaging said first sleeve to provide an adjustable displacement for said rearward extension; and said upward extension slidably engaging said second sleeve to provide an adjustable displacement for said upward extension; whereby said rearward and upward extensions are adjustably extendable with respect to said central articulating section.

13. A chair-stabilizing system preventing the overturning of a chair when adjacent to a generally flat surface as set forth in claim 12, wherein said central articulating section further comprises:

a first stop coupled to said second sleeve and hingedly coupled to said first sleeve, said first stop permitting said first and second sleeves to fold parallel to one another and to unfold perpendicular to one another.

14. A chair-stabilizing system preventing the overturning of a chair when adjacent to a generally flat as set forth in claim 13, wherein said central articulating section further comprises:

said first and second sleeves unlockably locking said rearward and upward extensions in place, respectively; and said first and second sleeves unlockably locking with respect to one another in said parallel and perpendicular positions.

15. A chair-stabilizing system preventing the overturning of a chair when adjacent to a generally flat surface as set forth in claim 14, wherein said central articulating section further comprises:

said locking of said first and second sleeves with respect to said rearward and upward extensions and with respect to each other is achieved by means selected from the group consisting of: biased spring pins retractably extending through holes, removable fasteners of all sorts including bolts, screws, pins, detents, dowels, pegs, and posts, and combinations thereof.

16. A chair-stabilizing system preventing the overturning of a chair when adjacent to a generally flat surface as set forth in claim 14, wherein said central articulating section further comprises:

a forward extension coupled to and aligned with said rearward extension.

17. A chair-stabilizing system preventing the overturning of a chair when adjacent to a generally flat surface as set forth in claim 3, wherein said flat surface-engaging portion further comprises:

a lower articulating section slidably coupled to said front section of said chair-engaging portion; and an upper flat surface-engaging extension slidably coupled to said lower articulating section.

18. A chair-stabilizing system preventing the overturning of a chair when adjacent to a generally flat surface as set forth in claim 17, wherein said lower articulating section further comprises:

third and fourth sleeves, said third sleeve hingedly coupled to said fourth sleeve;

said front section of said chair-engaging portion slidably engaging said third sleeve to provide detachable attachment between said third sleeve and said front section; and said upper flat surface-engaging extension slidably engaging said fourth sleeve to provide an adjustable displacement for said upper flat surface-engaging extension; whereby said upper flat surface-engaging extension is adjustably extendable with respect to said lower articulating section.

19. A chair-stabilizing system preventing the overturning of a chair when adjacent to a generally flat surface as set forth in claim 18, wherein said lower articulating section further comprises:

a second stop coupled to said fourth sleeve and hingedly coupled to said third sleeve, said second stop permitting said third and fourth sleeves to fold parallel to one another and to unfold perpendicular to one another.

20. A chair-stabilizing system preventing the overturning of a chair when adjacent to a generally flat surface as set forth in claim 19, wherein said lower articulating section further comprises:

said third sleeve unlockably locking said front section in place;

said fourth sleeve unlockably locking said upper flat surface-engaging extension in place, respectively; and said third and fourth sleeves unlockably locking with respect to one another in said parallel and perpendicular positions.

21. A chair-stabilizing system preventing the overturning of a chair when adjacent to a generally flat surface as set forth in claim 20, wherein said lower articulating section further comprises:

said locking of said third and fourth sleeves with respect to said front section and said upper flat surface-engaging extension, respectively, and with respect to each other is achieved by means selected from the group consisting of: biased spring pins retractably extending through holes, removable fasteners of all sorts including bolts, screws, pins, detents, dowels, pegs, and posts, and combinations thereof.

22. A chair-stabilizing system preventing the overturning of a chair when adjacent to a generally flat surface as set forth in claim 20, wherein said lower articulating section further comprises:

said third sleeve slidably engaging a forward extension of said front section of said chair-engaging portion, said front section coupled to and aligned with a rearward extension of said rear section of said chair-engaging section.

23. A chair-stabilizing system preventing the overturning of a chair when adjacent to a generally flat surface as set forth in claim 22, wherein said lower articulating section further comprises:

said third sleeve slidably receiving said forward extension which, in turn, slidably receives said rearward extension.

24. A chair-stabilizing system preventing the overturning of a chair when adjacent to a generally flat surface as set forth in claim 17, wherein said upper flat surface-engaging extension further comprises:

a flat surface-engagement plate extending outwardly from a distal end of said upper flat surface-engaging extension, said flat surface-engagement plate adapted to engage an underside of the generally flat surface.

25. A chair-stabilizing system preventing the overturning of a chair when adjacent to a generally flat surface as set forth in claim 24, wherein said flat surface-engagement plate further comprises:

a third pad coupled to flat surface-engagement plate and adapted to engage the underside of the generally flat surface, said third pad providing a compressible and generally non-scratching surface.

26. A method for stabilizing a chair to prevent the overturning of the chair when adjacent to a generally flat surface, the steps comprising:

providing a chair-stabilizing system having a chair-engaging portion and flat surface-engaging portion;

said chair-engaging portion having a front section and a rear section, said chair-engaging portion adapted to detachably attach to the chair;

said flat surface-engaging portion coupled to said front section of said chair-engaging portion, said flat surface-engaging portion adapted to engage an underside of the flat surface when said chair-engaging portion is engaging the chair and said chair-engaging portion is tilted rearwardly;

engaging the chair with said chair-engaging portion; and placing said flat surface-engaging portion beneath the generally flat surface; whereby the chair engaged by said chair-engaging portion cannot topple over rearwardly as rearward rotation of said chair-engaging portion is prevented by contact of said flat surface-engaging portion with an underside of the generally flat surface, said chair-engaging portion preventing rotation of the chair, the chair remaining able to slide and move with respect to the flat surface as it is not attached to the flat surface.

27. A method for stabilizing a chair to prevent the overturning of the chair when adjacent to a generally flat surface as set forth in claim 26, the steps further comprising:

providing a chair-stabilizing system that is collapsible and foldable.

28. A method for stabilizing a chair to prevent the overturning of the chair when adjacent to a generally flat surface as set forth in claim 26, wherein said chair-engaging portion further comprises:

said rear section including a rearward extension adapted to engage a rear portion of the chair; and said front section including an upward extension adapted to engage a top portion of the chair; whereby the chair is trapped between said rearward extension and said upward extension, said chair-engaging portion generally constrained to move with the chair.

29. A method for stabilizing a chair to prevent the overturning of the chair when adjacent to a generally flat surface as set forth in claim 28, wherein said rearward extension further comprises:

said rearward extension passing under the top portion of the chair to trap the top portion between said upward extension and said rearward extension.

30. A method for stabilizing a chair to prevent the overturning of the chair when adjacent to a generally flat surface as set forth in claim 29, wherein said rearward extension further comprises:

an upward engagement plate extending upwardly from a distal end of said rearward extension, said upward engagement plate adapted to engage a rear side of the top portion of the chair.

31. A method for stabilizing a chair to prevent the overturning of the chair when adjacent to a generally flat surface as set forth in claim 30, wherein said upward engagement plate further comprises:

a first pad coupled to said upward engagement plate and adapted to engage the rear side of the top portion of the chair, said first pad providing a compressible and generally non-scratching surface.

32. A method for stabilizing a chair to prevent the overturning of the chair when adjacent to a generally flat surface as set forth in claim 28, wherein said upward extension further comprises:

said upward extension passing in front of a front portion of the chair to trap the top portion between said rearward extension and said upward extension.

33. A method for stabilizing a chair to prevent the overturning of the chair when adjacent to a generally flat surface as set forth in claim 32, wherein said upward extension further comprises:

a rearward engagement plate extending rearwardly from a distal end of said upward extension, said rearward engagement plate adapted to engage a top side of the top portion of the chair.

34. A method for stabilizing a chair to prevent the overturning of the chair when adjacent to a generally flat surface as set forth in claim 33, wherein said upward engagement plate further comprises:

a second pad coupled to said rearward engagement plate and adapted to engage the top side of the top portion of the chair, said second pad providing a compressible and generally non-scratching surface.

35. A method for stabilizing a chair to prevent the overturning of the chair when adjacent to a generally flat surface as set forth in claim 28, wherein said chair-engaging portion further comprises:

a central articulating section having first and second sleeves, said first sleeve hingedly coupled to said second sleeve;

said rearward extension slidably engaging said first sleeve to provide an adjustable displacement for said rearward extension; and said upward extension slidably engaging said second sleeve to provide an adjustable displacement for said upward extension; whereby said rearward and upward extensions are adjustably extendable with respect to said central articulating section.

36. A method for stabilizing a chair to prevent the overturning of the chair when adjacent to a generally flat surface as set forth in claim 35, wherein said central articulating section further comprises:

a first stop coupled to said second sleeve and hingedly coupled to said first sleeve, said first stop permitting said first and second sleeves to fold parallel to one another and to unfold perpendicular to one another.

37. A method for stabilizing a chair to prevent the overturning of the chair when adjacent to a generally flat surface as set forth in claim 36, wherein said central articulating section further comprises:

said first and second sleeves unlockably locking said rearward and upward extensions in place, respectively; and said first and second sleeves unlockably locking with respect to one another in said parallel and perpendicular positions.

38. A method for stabilizing a chair to prevent the overturning of the chair when adjacent to a generally flat surface as set forth in claim 37, wherein said central articulating section further comprises:

said locking of said first and second sleeves with respect to said rearward and upward extensions and with respect to each other is achieved by means selected from the group consisting of: biased spring pins retractably extending through holes, removable fasteners of all sorts including bolts, screws, pins, detents, dowels, pegs, and posts, and combinations thereof.

39. A method for stabilizing a chair to prevent the overturning of the chair when adjacent to a generally flat surface as set forth in claim 37, wherein said central articulating section further comprises:

a forward extension coupled to and aligned with said rearward extension.

40. A method for stabilizing a chair to prevent the overturning of the chair when adjacent to a generally flat surface as set forth in claim 26, wherein said flat surface-engaging portion further comprises:

a lower articulating section slidably coupled to said front section of said chair-engaging portion; and an upper flat surface-engaging extension slidably coupled to said lower articulating section.

41. A method for stabilizing a chair to prevent the overturning of the chair when adjacent to a generally flat surface as set forth in claim 40, wherein said lower articulating section further comprises:

third and fourth sleeves, said third sleeve hingedly coupled to said fourth sleeve;

said front section of said chair-engaging portion slidably engaging said third sleeve to provide detachable attachment between said third sleeve and said front section; and said upper flat surface-engaging extension slidably engaging said fourth sleeve to provide an adjustable displacement for said upper flat surface-engaging extension; whereby said upper flat surface-engaging extension is adjustably extendable with respect to said lower articulating section.

42. A method for stabilizing a chair to prevent the overturning of the chair when adjacent to a generally flat surface as set forth in claim 41, wherein said lower articulating section further comprises:

a second stop coupled to said fourth sleeve and hingedly coupled to said third sleeve, said second stop permitting said third and fourth sleeves to fold parallel to one another and to unfold perpendicular to one another.

43. A method for stabilizing a chair to prevent the overturning of the chair when adjacent to a generally flat surface as set forth in claim 42, wherein said lower articulating section further comprises:

said third sleeve unlockably locking said front section in place;

said fourth sleeve unlockably locking said upper flat surface-engaging extension in place, respectively; and said third and fourth sleeves unlockably locking with respect to one another in said parallel and perpendicular positions.

44. A method for stabilizing a chair to prevent the overturning of the chair when adjacent to a generally flat surface as set forth in claim 43, wherein said lower articulating section further comprises:

said locking of said third and fourth sleeves with respect to said front section and said upper flat surface-engaging extension, respectively, and with respect to each other is achieved by means selected from the group consisting of: biased spring pins retractably extending through holes, removable fasteners of all sorts including bolts, screws, pins, detents, dowels, pegs, and posts, and combinations thereof.

45. A method for stabilizing a chair to prevent the overturning of the chair when adjacent to a generally flat surface as set forth in claim 43, wherein said lower articulating section further comprises:

said third sleeve slidably engaging a forward extension of said front section of said chair-engaging portion, said front section coupled to and aligned with a rearward extension of said rear section of said chair-engaging section.

46. A method for stabilizing a chair to prevent the overturning of the chair when adjacent to a generally flat surface as set forth in claim 45, wherein said lower articulating section further comprises:

said third sleeve slidably receiving said forward extension which, in turn, slidably receives said rearward extension.

47. A method for stabilizing a chair to prevent the overturning of the chair when adjacent to a generally flat surface as set forth in claim 40, wherein said upper flat surface-engaging extension further comprises:

a flat surface-engagement plate extending outwardly from a distal end of said upper flat surface-engaging extension, said flat surface-engagement plate adapted to engage an underside of the generally flat surface.

48. A method for stabilizing a chair to prevent the overturning of the chair when adjacent to a generally flat surface as set forth in claim 47, wherein said flat surface-engagement plate further comprises:

a third pad coupled to said flat surface-engagement plate and adapted to engage the underside of the generally flat surface, said third pad providing a compressible and generally non-scratching surface.

* * * * *